US010808362B2

(12) United States Patent
Seyrlehner

(10) Patent No.: US 10,808,362 B2
(45) Date of Patent: Oct. 20, 2020

(54) TAMPING UNIT AND METHOD FOR TAMPING A TRACK

(71) Applicant: PLASSER & THEURER EXPORT VON BAHNBAUMASCHINEN GESELLSCHAFT M.B.H., Vienna (AT)

(72) Inventor: Georg Seyrlehner, Chesapeake, VA (US)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 213 days.

(21) Appl. No.: 15/767,554

(22) PCT Filed: Oct. 21, 2016

(86) PCT No.: PCT/EP2016/001747
§ 371 (c)(1),
(2) Date: Apr. 11, 2018

(87) PCT Pub. No.: WO2017/084733
PCT Pub. Date: May 26, 2017

(65) Prior Publication Data

US 2018/0298565 A1 Oct. 18, 2018

(30) Foreign Application Priority Data

Nov. 20, 2015 (AT) ..... 749/2015

(51) Int. Cl.
*E01B 27/17* (2006.01)
*E01B 27/16* (2006.01)
(Continued)

(52) U.S. Cl.
CPC ..... *E01B 27/17* (2013.01); *B06B 1/162* (2013.01); *B06B 1/164* (2013.01); *B07B 1/44* (2013.01);
(Continued)

(58) Field of Classification Search
CPC ..... E01B 27/16; E01B 27/17; E01B 27/20; E01B 2203/127; B06B 1/162; B06B 1/164; B07B 1/44
See application file for complete search history.

(56) References Cited

U.S. PATENT DOCUMENTS 4,240,352 A * 12/1980 Theurer ..... E01B 27/16 104/12
2005/0193918 A1* 9/2005 Seyrlehner ..... E01B 27/16 104/10
(Continued)

FOREIGN PATENT DOCUMENTS

AT 350097 B 5/1979
AT 513973 A4 9/2014
(Continued)

*Primary Examiner* — Jason C Smith
(74) *Attorney, Agent, or Firm* — Laurence A. Greenberg; Werner H. Stemer; Ralph E. Locher

(57) ABSTRACT

A tamping unit for tamping a track has tamping tines which are designed for immersion into a ballast bed and which can be set in vibrations by a vibration drive. The vibration drive includes a housing in which a shaft including an eccentric is arranged for rotation about a shaft axis. A transmission element for transmitting a vibratory motion is mounted on the eccentric. The eccentric is connected to the shaft in a rotation-locked and radially displaceable manner, wherein the position of the eccentric relative to the shaft is adjustable in radial direction by an adjustment device. Thus, while retaining the advantages of an eccentric drive, it is possible to adjust vibration parameters during operation.

13 Claims, 4 Drawing Sheets

(51) Int. Cl.

| | |
|---|---|
| ***B06B 1/16*** | (2006.01) |
| ***B07B 1/44*** | (2006.01) |
| ***E01B 27/20*** | (2006.01) |

(52) U.S. Cl.
CPC ..... *E01B 27/16* (2013.01); *E01B 27/20* (2013.01); *E01B 2203/127* (2013.01)

(56) References Cited

U.S. PATENT DOCUMENTS

| | | | | |
|---|---|---|---|---|
| 2015/0083014 | A1* | 3/2015 | Pritzl | B06B 1/16 104/10 |
| 2016/0010287 | A1* | 1/2016 | Lichtberger | E01B 27/16 104/10 |
| 2017/0275828 | A1* | 9/2017 | Seyrlehner | B06B 1/18 |
| 2018/0298565 | A1* | 10/2018 | Seyrlehner | E01B 27/20 |

FOREIGN PATENT DOCUMENTS

| | | | | |
|---|---|---|---|---|
| EP | 1172480 | A2 | 1/2002 | |
| EP | 2770108 | A1 | 8/2014 | |
| WO | 9948600 | A1 | 9/1999 | |
| WO | WO-9948600 | A1 * | 9/1999 | B06B 1/16 |
| WO | 2008017371 | A1 | 2/2008 | |

* cited by examiner

TAMPING UNIT AND METHOD FOR TAMPING A TRACK

FIELD OF TECHNOLOGY

The invention relates to a tamping unit for tamping a track, having tamping tines which are designed for immersion into a ballast bed and can be set in vibrations by means of a vibration drive, wherein the vibration drive comprises a housing in which a shaft including an eccentric is arranged for rotation about a shaft axis and wherein a transmission element for transmitting a vibratory motion is mounted on the eccentric. The invention further relates to a method of tamping a track by means of the tamping unit, wherein the generated vibratory motion is transmitted via a squeezing drive to a tine arm.

PRIOR ART

Due to the great strain which a tamping unit is subjected to, the vibration drive must fulfil special requirements. During immersion of the tamping tine into a ballast bed of a track, and during the subsequent compaction of the ballast underneath a sleeper, load changes occur constantly which stress the vibration drive. In particular, when tamping a ballast bed which has not been renewed and which is often totally encrusted, high counterforces act upon the tamping tine which is set in vibrations by means of the vibration drive. Even under such difficult operating conditions, the vibration drive must maintain the required vibration of the tamping tines with approximately constant vibration amplitude in order to ensure a uniform tamping quality.

Therefore, for application in tamping units, a vibration drive known from patent AT 350 097 B has proved successful, in which an oscillating vibratory motion is produced by means of a powered eccentric shaft. In this design, the vibration amplitude is fixedly predetermined by the dimensioning of the eccentric shaft. The vibratory motion transmitted to the tamping tines via squeezing cylinders and tine arms thus remains largely unaffected by the resistance of the ballast bed.

In a design known from AT 513 973 A, the vibratory motion is generated by means of a hydraulic linear drive. In the absence of specific measures, an increased ballast bed resistance here leads to an undesired reduction of the vibration amplitude. On the other hand, a hydraulic linear drive enables an easy adjustment of the vibration parameters all the way to a rapid succession of switching-on and -off procedures. The latter is more difficult to implement in a known vibration drive with eccentric shaft, based on the inertia of the masses which are in rotation.

SUMMARY OF THE INVENTION

It is the object of the invention to provide an improvement over the prior art for a vibration drive of the type mentioned at the beginning. A further object is to provide a corresponding method of tamping a track.

According to the invention, these objects are achieved with a tamping unit as claimed and a method as claimed. Further embodiments are found in the dependent claims.

In this, the eccentric is connected to the shaft in a rotation-locked and radially displaceable manner, wherein the position of the eccentric relative to the shaft can be adjusted in radial direction by means of an adjustment device. In operation, a torque is transmitted by means of the shaft to the eccentric configured as a separate component.

The effect upon the transmission element is thereby defined by an adjustable axis distance between an eccentric axis and the shaft axis. Specifically, the amplitude of the vibratory motion transmittable by means of the transmission element is steplessly adjustable. While retaining the advantages of an eccentric drive, the possibility is thus created to adjust vibration parameters during operation. In this, a change of the distance between the eccentric axis and the shaft axis leads not only to a changed vibration amplitude but, with steady torque, also to a changed impact force applied by means of the vibration drive.

An advantageous further development of the invention provides that the transmission element is designed as a connecting rod for transmission of an oscillating vibratory motion. The connecting rod can then be connected to a piston guided in a linear way, by means of which the vibration can be transmitted to several components.

In a simple embodiment, the shaft has, at a shell surface, two oppositely positioned parallel flat portions by means of which the eccentric is guided radially. In the direction of rotation, the flat portions, together with the correspondingly configured counter surfaces of the eccentric, establish a form-locking connection in order to safely transmit a torque.

It is further advantageous if the adjustment device comprises at least one hydraulic cylinder with a piston, wherein an adjustment force can be exerted upon the eccentric by means of the piston. Thus it is possible to use a hydraulic system, often already present, to carry out an adjustment of the eccentric relative to the shaft.

In this, favourably, the hydraulic cylinder is arranged in the shaft. Said cylinder is connected to a hydraulic line conducted in the shaft, resulting in a compact and weight-saving embodiment of the adjustment device.

Advantageously, the hydraulic cylinder is controlled by means of a pre-controlled check valve. This guarantees that, after an adjustment operation, the cylinder remains fixed in its position even if high counter forces act upon the eccentric.

A further embodiment of the invention provides that the adjustment device comprises a further cylinder having a piston for fixing and/or returning the eccentric. The eccentric is thus clamped in its position between two pistons, whereby a particularly robust fixation exists. Favourably in this, the second piston also is controlled by means of a pre-controlled check valve.

An improvement of the operational possibilities of the tamping unit is present if the adjustment device is connected to a control and/or a governing device. In this manner, the vibration drive of the tamping unit can be adjusted to changed conditions automatically during operation.

For generating a feedback after an adjustment operation, it is advantageous if the vibration drive has a sensor for detecting a momentary axis distance between the shaft axis and an eccentric axis. In this way, it is possible to check whether a prescribed axis distance has in fact been set or is maintained during operation. Thus, malfunctions can be instantly detected.

Additionally, it is advantageous if the vibration drive comprises a sensor for detecting an angle position and/or angular velocity of the shaft. This creates the possibility to determine an actual speed of rotation of the shaft at any time, and to prescribe a preferred starting and end position for the vibration drive, for example. Furthermore, several vibration drives can be operated synchronously in this manner.

A simple drive variation provides that the shaft is connected to a variable hydraulic motor. Beside the advantageous use of an often already present hydraulic system, this enables a simple adjustment of a vibration frequency in that the speed of rotation of the shaft is changed.

To reduce the power consumption of the vibration drive, it is advantageous if the shaft is coupled to a flywheel. That is because during a vibration cycle, energy is continuously given off or taken up by slowed down or accelerated masses. The flywheel serves as an intermediate store for balancing out these energy fluctuations.

In a method, according to the invention, for tamping a track by means of a tamping unit described above, the generated vibratory motion is transmitted via a squeezing cylinder and a tine arm to the respective tamping tine, wherein the vibratory motion is changed in that, by means of the adjustment device, the eccentric is adjusted in radial direction relative to the shaft. In particular, an adaptation of the vibration amplitude takes place during operation.

The invention is advantageously further developed in the manner that a tamping cycle is formed of several phases taking place one after the other, and that, by means of a control and/or governing device, in at least one phase a different axis distance between the shaft axis and an eccentric axis is set versus another phase. Individual phases of the tamping cycle are formed, for instance, by a lowering of the tamping unit, a squeezing of the tamping tines, a lifting of the tamping unit, and a repositioning of the tamping unit. Due to the adjustability, the vibration drive is optimally employed for the respective phase.

In this, it is advantageous if, in at least one phase of the tamping cycle, an axis distance is set to zero in order to suspend the vibration for a desired duration independently of the speed of rotation of the shaft. This is expedient particularly during a repositioning of the tamping unit between two tamping operations in order to diminish noise and to reduce power consumption of the vibration drive.

In addition it is advantageous if, during a tamping cycle, the shaft is driven with different speeds of rotation. In this manner, the vibration frequency can be adapted to various requirements during a tamping cycle. During an immersion procedure, for instance, a higher speed of rotation is set because the immersion resistance of the ballast bed diminishes with higher vibration frequency.

BRIEF DESCRIPTION OF THE DRAWINGS

The invention will be explained below by way of example with reference to the attached figures, showing in schematic representation.

DESCRIPTION OF EMBODIMENTS

Figure 1:
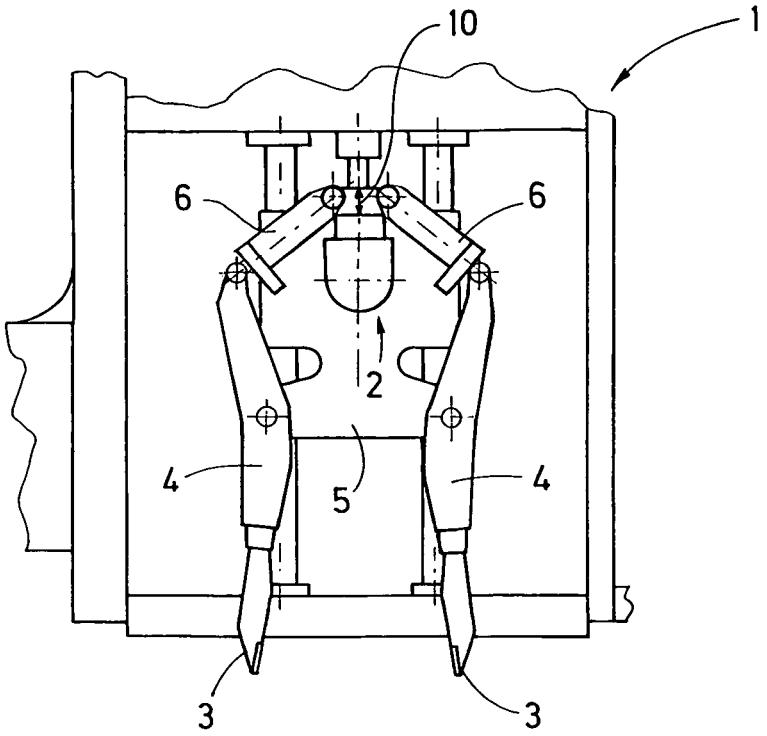
FIG. 1 a tamping unit having two tine arms.

The tamping unit 1 shown in FIG. 1 comprises an adjustable vibration drive 2 for setting in vibration two oppositely positioned tamping tines 3 or tamping tine groups. In this, each tamping tine 3 is fastened to a tine arm 4. The respective tine arm 4 is pivotally linked to a tamping tine carrier 5, designed to be lowered, and connected to a piston rod of an associated squeezing cylinder 6. Also fastened to the tamping tine carrier 5 is the vibration drive 2 to which each tine arm 4 is connected via the associated squeezing cylinder 6. A generated vibration is thus transmitted via the respective squeezing cylinder 6 to the respective tine arm 4 and the tamping tine 3 fastened thereto.

Figure 2:
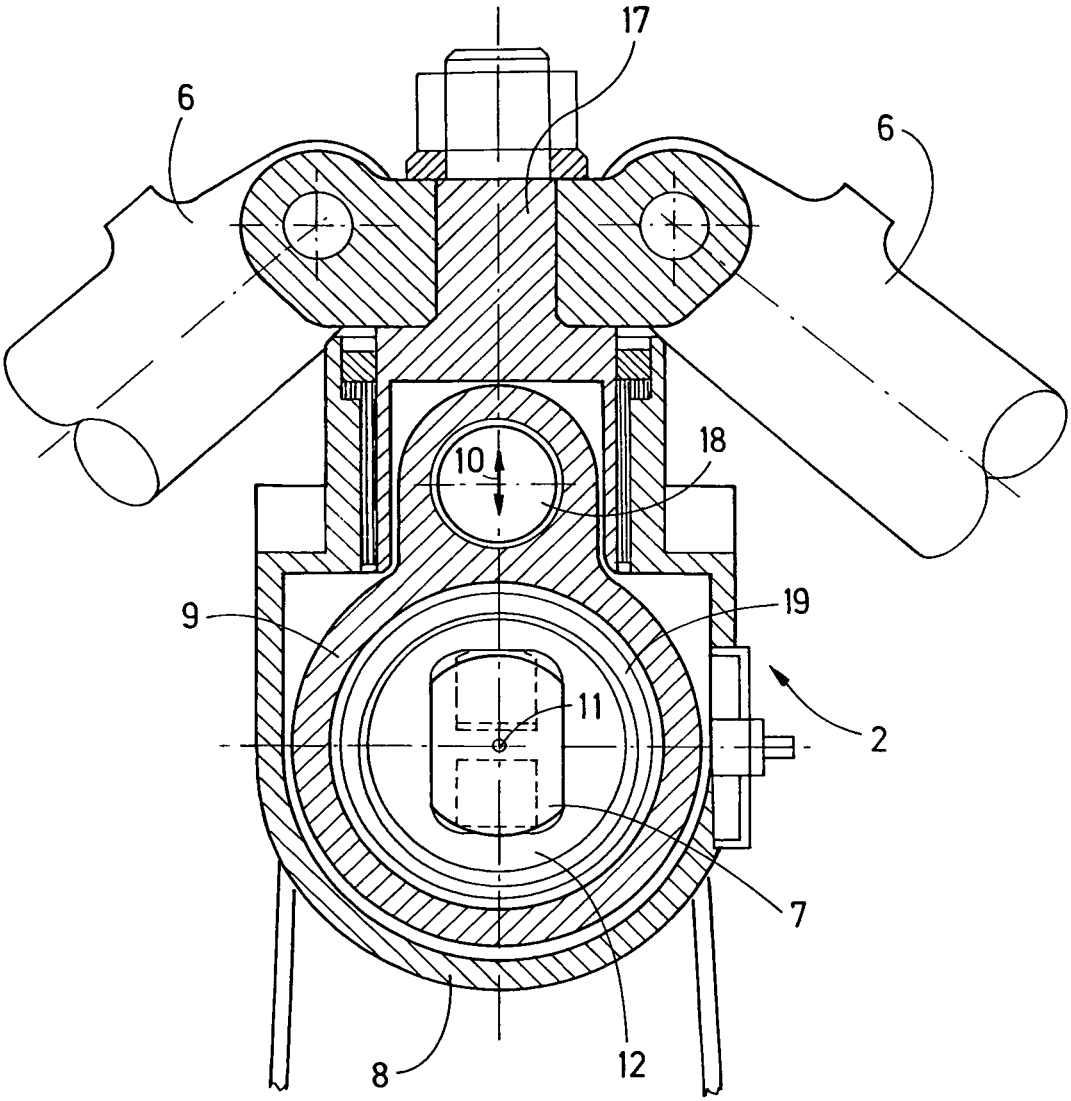
FIG. 2 a vibration drive of the tamping unit according to FIG. 1.

As visible in FIG. 2, the vibration drive comprises a shaft 7 which is mounted in a housing 8 with sealed passages. At least one additional sealed passage is provided for a transmission element 9 to which the squeezing cylinders 6 of the tamping unit 1 are connected. Advantageously, the shaft 7 is mounted in the housing 8 by means of rolling bearings. The components of the vibration drive 2 cause an oscillating vibratory motion 10 during operation. In this, the shaft 7 rotates about a shaft axis 11 and is connected in a rotation-locked way to an eccentric 12.

FIGS. 3-6 show that an axis distance 15 between an eccentric axis 13 and the shaft axis 11 can be set by means of an adjustment device 14. If the set axis distance 15 is greater than zero, a rotary motion 16 of the shaft 7 and the eccentric 12 is transmitted into the vibratory motion 10 by means of the transmission element 9. In the embodiment shown, the transmission element 9 is designed as a connecting rod which is articulatedly connected to a piston element 17 guided in a linear way. A bolt 18 is provided for connection of the piston element 17 to the transmission element 9.

Those components which are to be subjected to the vibratory motion 10 are connectable to the piston element 17. In a simplier variant, the respective squeezing cylinder is mounted directly on the eccentric by means of an appropriate connection and functions itself as transmission element 9. The oil lubricated rolling bearing 19, shown in FIG. 2, between transmission element 9 and eccentric 12 is not shown in FIGS. 3-6 for reasons of clarity.

Figure 3:
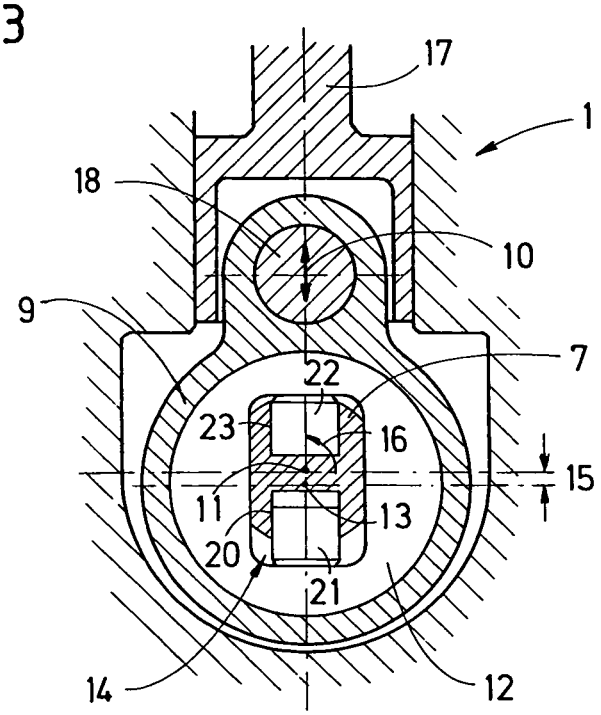
FIG. 3 a section view of the vibration drive in elevation.

Advantageously, the adjustment device 14 comprises a hydraulic cylinder 20 which is arranged in the shaft 7 and presses a piston 21 against an inner surface of the eccentric 12 resting on the shaft 7. By means of this pressing force, the eccentric 12 is adjustable relative to the shaft 7. In order to fixate the eccentric 12 in its respective position or return it, a further element of the adjustment device 14 produces a counter force on an oppositely positioned inner surface of the eccentric 12. Said counter force is applied, for example, by means of a spring or—as shown in FIG. 3—by means of a further piston 22 of a further cylinder 23.

Instead of a hydraulic adjustment device 14, a mechanical adjustment device (not shown) can be used. This comprises, for example, spindles or crankshafts guided in the shaft 7 in order to adjust the position of the eccentric 12 relative to the shaft 7.

Figure 4:
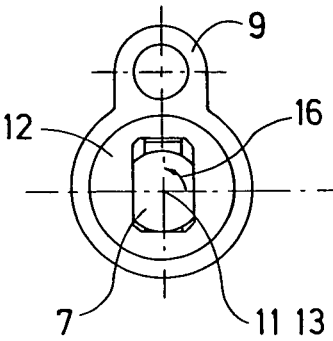
FIG. 4 a section view with eccentric in zero position.
Figure 5:
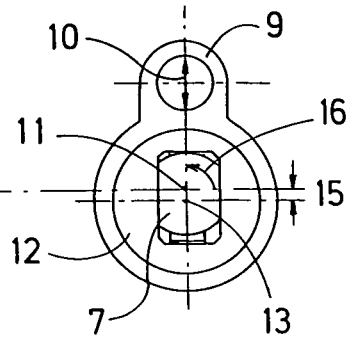
FIG. 5 a section view with eccentric at maximum axis distance.

FIGS. 4 and 5 show, in a simplified manner of representation, two end positions of the adjustable eccentric 12. In FIG. 4, the axis distance 15 between the shaft axis 11 and the eccentric axis 13 equals zero. Here, the rotary motion 16 of the shaft 7 and of the eccentric 12 do not cause a vibratory motion. This setting of the eccentric thus serves for suspending the vibration.

In FIG. 5, a maximum axis distance 15 is set between the shaft axis 11 and the eccentric axis 13. The transmission element 9, designed as a connecting rod, then transmits an oscillating vibratory motion 10 with a vibration amplitude which corresponds to the maximum axis distance 15. Due to the given kinematic arrangement of the respective squeezing cylinder 6 and the respective tine arm 4 and the respective tamping tine 3, a desired vibration amplitude results at the free end of the tamping tine 3.

By suitable control of the adjustment device 14, any value between zero and a maximum value can be set for the axis distance 15. In this, with the torque remaining constant, a reduced axis distance 15 leads not only to a reduced vibration amplitude but also to a higher striking force of the vibration drive 2. This is advantageous for the operation of the tamping unit 1 in order to adapt the effect of the respective vibrating tamping tine 3 upon a ballast bed, if required.

Figure 6:
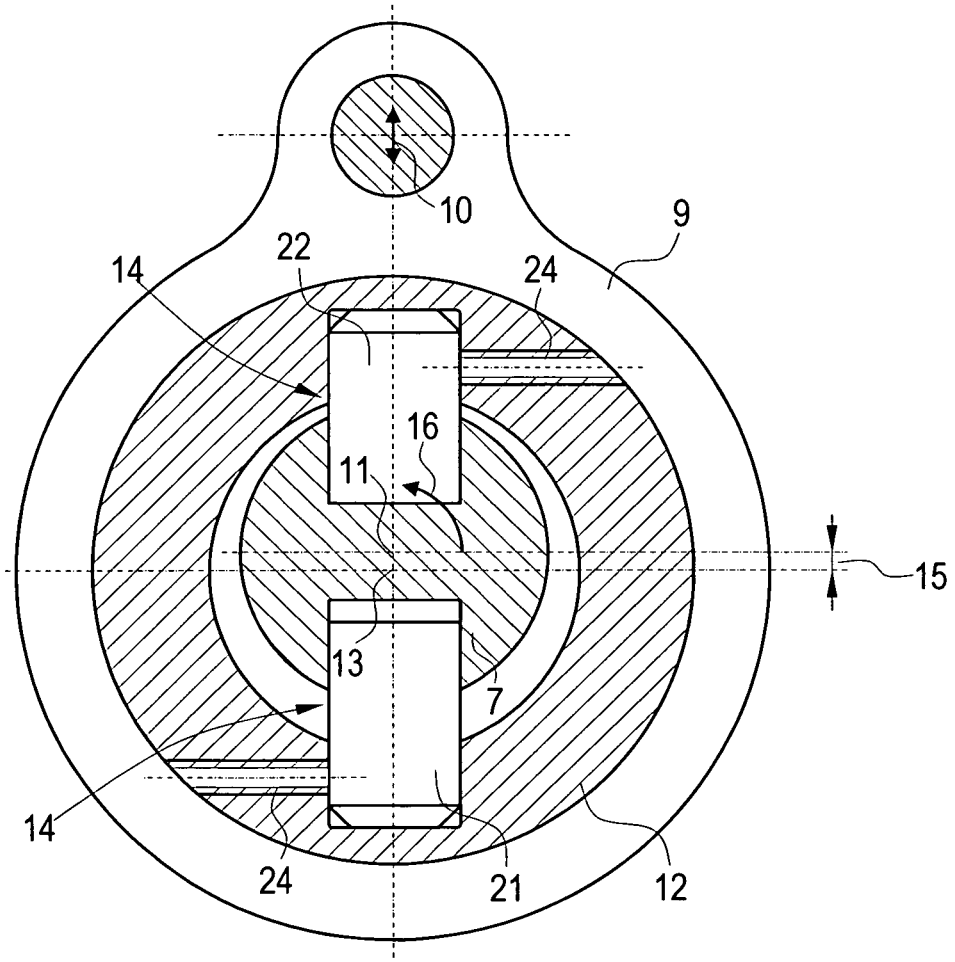
FIG. 6 an embodiment having an alternative adjustment device.

In an alternative adjustment device 14 according to FIG. 6, the eccentric 12 does not rest on the shaft 7, but is connected via the adjustment device 14 to the shaft 7 in a rotation-locked and radially adjustable manner. For example, in the case of a hydraulic embodiment, the free ends of the pistons 21, 22 are inserted in a respective longitudinal groove on an inner surface of the eccentric 12 and fixed in the longitudinal direction by means of fastening means 24. In this way, the pistons 21, 22 on the one hand serve for adjustment in radial direction and, on the other hand, as elements of a rotation-locked connection between the shaft 7 and the eccentric 12.

Figure 7:
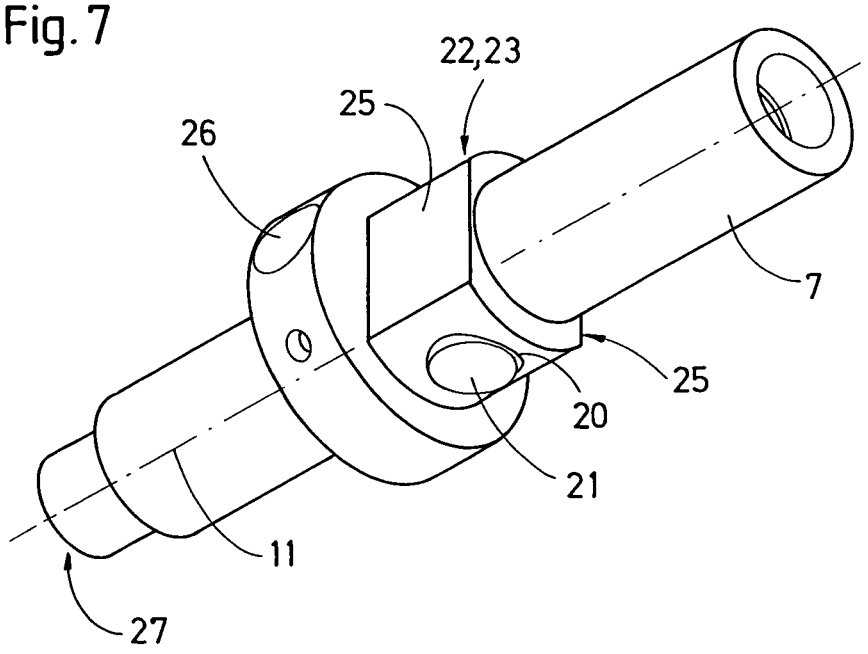
FIG. 7 a perspective view of the shaft according to FIG. 2.

The shaft 7, shown in FIG. 7, according to the embodiment in FIG. 2 has two flat portions 25 by means of which the eccentric 12 is guided radially. In the region of these flat portions 25, two hydraulic cylinders 20, 23 are arranged in the shaft 7 as elements of the adjustment device 14. In the installed position, the pistons 21, 22 press against the inner surfaces of the eccentric 12, causing the latter to be displaced radially with respect to the shaft axis 11. In this, the inner surfaces of the eccentric 12 glide along the flat portions 25 of the shaft 7.

By means of hydraulic lines arranged in the shaft 7, each cylinder 20, 23 is connected to a respective pre-controlled check valve 26. Conveniently, the check valves 26 are likewise arranged in the shaft 7 to ensure very short connecting lines between the pre-controlled check valves 26 and the cylinders 20, 23. This enables a rapid response of the adjustment device 14. Furthermore, the compressible amount of fluid is minimised, so that the compressibility of a hydraulic fluid used is negligible. The use of two cylinders 20, 23 controlled by means of pre-controlled check-valves 26 causes a secure fixation of the eccentric 12 in its set position relative to the shaft 7.

Supply lines and control lines of the adjustment device 14 are led outward, for instance, at a head face 27 of the shaft 7. A connection of these rotating lines to a hydraulic system takes place by means of a known rotary transmission.

With the method according to the invention, the vibratory motion 10 can be adapted to individual phases of a tamping cycle. At the start of the tamping cycle, first the tamping tine carrier 5 is lowered. During this phase, the tamping tines 3 plunge into a ballast bed of a track. In this, the tamping tines 3 vibrate with a vibration frequency of up to 60 Hz, and in the vibration drive 2 the maximum axis distance 15 between the shaft axis 11 and the eccentric axis 13 is set. Thus, the greatest possible vibration amplitude results at the free end of the respective tamping tine 3.

In a next phase, the compaction of the ballast underneath a sleeper takes place. The tamping tines 3 lying opposite one another in the direction of the track move towards one another with a squeezing motion, in that each squeezing cylinder 6 exerts a torque upon the associated tine arm 4. In this, the vibratory motion 10 generated by means of the vibration drive 2 continues to be superimposed on the squeezing motion. By adjustment of the speed of rotation of the shaft 7, the vibration frequency during this phase is set to 35 Hz.

If the shaft 7 is already powered with a maximum torque, the striking force of the tamping tines 3 can be increased in this phase, if required, by slight reduction of the axis distance 15 between the shaft axis 11 and the eccentric axis 13. Such a measure might be useful in the case of a heavily encrusted ballast bed. In this, the axis distance 15 is reduced only so far that the resulting reduction of the vibration amplitude remains negligible.

During a vibration period, the vibrating masses of the squeezing cylinders 6 and the tine arms 4 and tamping tines 3 are first accelerated and decelerated in one direction and subsequently accelerated and decelerated in the opposite direction. Therefore, these vibratory motions cause a continuous emission and absorption of kinetic energy. A major part of this fluctuating energy is intermediately stored in the consistently swinging rotating masses of the shaft 7 and the eccentric 12.

Conveniently, the shaft 7 is additionally coupled to a flywheel in order to keep the angular velocity of the rotating masses constant over the course of a vibration period independently of a rotation drive. The power consumption of the vibration drive 2 according to the invention is thus significantly less than that of a linear vibration drive which generates a vibration by means of a hydraulic cylinder, for example.

As soon as the compaction process is finished, the tamping tines 3 are pulled out of the ballast bed by lifting the tamping tine carrier 5. During this, the squeezing cylinders 6 are also reset. In this phase of the tamping cycle, the vibration is interrupted until the next insertion of the tamping tines 3, in that the axis distance 15 between the shaft axis 11 and the eccentric axis 13 is set to zero.

Specifically, the vibration amplitude is reduced all the way to zero, wherein the vibration frequency remains constant during this reduction process. Without the adjustment of the eccentric according to the invention, the shaft 7 would have to be braked in order to interrupt the vibrations. In this, the vibration drive 2 would inevitably pass through low frequency ranges. Components of a tamping machine comprising the tamping unit 1, or elements of the track, mostly have low natural frequencies, so that there would be undesirable resonances. Additionally, a cyclic braking and accelerating of the rotating masses would significantly increase the power consumption of the vibration drive 2.

To automatically perform the changes of the position of the eccentric carried out in the individual phases of a tamping cycle, the adjustment device 14 is controlled by means of a control and/or governing device. Various sensors may be attached to the tamping unit 1 to detect in real time vibration parameters, such as frequency or amplitude, and to report these to the control or governing device. In particular, a sensor may be provided for detecting the momentary axis distance 15 between the shaft axis 11 and the eccentric axis 13. Thus it is possible to realize an especially precise adjustment of the axis distance 15.

The shaft 7 is powered by a hydraulic motor using the hydraulic system present in the tamping machine. As a result, a sufficiently high torque is available, and the speed of rotation can be set steplessly.

The invention claimed is:

1. A tamping unit for tamping a track, the tamping unit comprising:

tamping tines configured for immersion into a ballast bed;

a vibration drive for vibrating said tamping tines, said vibration drive having a housing and a shaft rotatably mounted for rotation about a shaft axis;

an eccentric connected to said shaft in a rotation-locked and radially displaceable relationship, and a transmission element for transmitting a vibratory motion mounted to said eccentric; and an adjustment device configured to adjust a position of said eccentric relative to said shaft in a radial direction, said adjustment device including at least one hydraulic cylinder with a piston configured for exerting an adjustment force upon said eccentric, said hydraulic cylinder being arranged in said shaft.

2. The tamping unit according to claim 1, wherein said transmission element is a connecting rod for transmission of an oscillating vibratory motion.

3. The tamping unit according to claim 1, wherein said hydraulic cylinder is controlled by way of a pre-controlled check valve.

4. The tamping unit according to claim 1, wherein said adjustment device comprises a further cylinder having a piston for fixing and/or returning said eccentric.

5. The tamping unit according to claim 1, which comprises a control and/or governing device connected to said adjustment device.

6. The tamping unit according to claim 1, wherein said vibration drive has a sensor for detecting a momentary axis distance between a shaft axis of said shaft and an eccentric axis of said eccentric.

7. The tamping unit according to claim 1, wherein said vibration drive comprises a sensor for detecting an angle position and/or angular velocity of said shaft.

8. The tamping unit according to claim 1, wherein said shaft is connected to a variable hydraulic motor.

9. A tamping unit for tamping a track, the tamping unit comprising:

tamping tines configured for immersion into a ballast bed;

a vibration drive for vibrating said tamping tines, said vibration drive having a housing and a shaft rotatably mounted for rotation about a shaft axis;

an eccentric connected to said shaft in a rotation-locked and radially displaceable relationship, and a transmission element for transmitting a vibratory motion mounted to said eccentric;

said shaft having, at a shell surface thereof, two oppositely positioned parallel flat portions configured for guiding said eccentric radially, and an adjustment device configured for adjusting a position of said eccentric relative to said shaft in a radial direction.

10. A method for tamping a track, the method comprising:

providing a tamping unit according to claim 1;

generating vibratory motion and transmitting the vibratory motion via a squeezing drive to a tine arm; and changing the vibratory motion by adjusting the eccentric relative to the shaft in radial direction by way of the adjustment device.

11. The method according to claim 10, which comprises forming a tamping cycle by performing a plurality of phases one after another, and during at least one of the phases, setting an axis distance between a shaft axis and an eccentric axis by a control and/or governing device, to a different axis distance relative to another one of the phases.

12. The method according to claim 11, which comprises, during at least one phase of the tamping cycle, setting an axis distance equalling zero.

13. The method according to claim 10, which comprises driving the shaft at mutually different speeds of rotation during a tamping cycle.

* * * * *